US010966557B1

(12) United States Patent
Gieck

(10) Patent No.: US 10,966,557 B1
(45) Date of Patent: Apr. 6, 2021

(54) UTENSIL RETENTION ORGANIZER

(71) Applicant: Kristin Gieck, Wheat Ridge, CO (US)

(72) Inventor: Kristin Gieck, Wheat Ridge, CO (US)

( * ) Notice: Subject to any disclaimer, the term of this patent is extended or adjusted under 35 U.S.C. 154(b) by 284 days.

(21) Appl. No.: 15/849,718

(22) Filed: Dec. 21, 2017

(51) Int. Cl.
*A47G 29/08* (2006.01)
*A47G 29/087* (2006.01)
*A47G 21/06* (2006.01)
*A47D 15/00* (2006.01)

(52) U.S. Cl.
CPC ..... *A47G 29/087* (2013.01); *A47G 21/06* (2013.01); *A47D 15/00* (2013.01)

(58) Field of Classification Search
CPC ..... A47G 29/087; A47G 21/06; A47D 15/00
See application file for complete search history.

(56) References Cited

U.S. PATENT DOCUMENTS 2,957,271 A * 10/1960 Heywood, Jr. ..... A63H 33/00 446/227
3,415,475 A * 12/1968 Goodman ..... F16M 11/22 248/158
5,339,770 A * 8/1994 Haffner ..... A01K 15/025 119/708
6,464,555 B1 * 10/2002 Paduano ..... A63H 33/006 446/227
7,806,085 B1 * 10/2010 Waddy ..... A01K 15/025 119/702
8,388,403 B2 * 3/2013 Seter ..... A47G 19/10 108/26
8,640,653 B2 * 2/2014 Cook ..... A01K 15/025 119/707
9,517,422 B2 * 12/2016 Resh ..... A63H 33/006
9,968,863 B2 * 5/2018 Sanders ..... A63H 13/18

* cited by examiner

*Primary Examiner* — Ko H Chan
(74) *Attorney, Agent, or Firm* — Gugliotta & Gugliotta, LPA

(57) ABSTRACT

An eating utensil organizer is provided having a base providing a lower support surface adapted to provide a stabilized surface for placement on a table or high chair tray. The housing forms an outer perimeter, and a vertical housing support connects the housing to the base. A plurality of utensil supports each connect a utensil to the outer perimeter in a cantilevered fashion. The lower support surface may include an attachment mechanism such as a suction cup or a weighted ballast. A rotatable hinge allows the housing to rotate radially relative to the base in a manner adapted to allow access to each of said utensil supports. Each utensil support is tethered between the housing and a utensil to a length sufficiently short such as to prevent the utensil from hitting a floor if dropped from a table top or high chair.

11 Claims, 6 Drawing Sheets

UTENSIL RETENTION ORGANIZER

RELATED APPLICATIONS

There are no previously filed, nor currently any co-pending applications, anywhere in the world.

BACKGROUND OF THE INVENTION

1. Field of the Invention

The present invention relates generally to eating utensils for toddlers and, more particularly, to a device for organizing a plurality of utensils in a manner that are both accessible and contained.

2. Description of the Related Art

As many parents know, the process of teaching toddlers to each encounters a variety of challenges, one of which is keeping the child's toys and utensils off the floor during meal time. Whether because of a child's temperament or merely as part of the learning process of manually manipulating a utensil, small children drop spoons and forks repeated during every meal.

Aside from the inconvenience associate with constantly bending to pick up dropped utensils, the situation creates hygiene issues in that floors can be dirtier than other surfaces and may harbor increased levels of bacteria. Further still, the situation may be exacerbated at restaurants, where access to clean replacement utensils or cleaning facilities are much less convenient than in one's own kitchen.

Consequently, a need exists for a system and device for retaining one or more eating utensils in a manner that are both accessible and contained.

SUMMARY OF THE INVENTION

It is thus an object of the present invention to provide a device for organizing a plurality of utensils in a manner that are both accessible and contained.

It is a feature of the present invention to provide a rotating housing that allows for a plurality of tethered utensils to be mounted thereto.

Briefly described according to the preferred embodiment, the present invention provides a system and method for preventing eating utensils from falling and hitting the floor. An eating utensil organizer is provided having a base providing a lower support surface adapted to provide a stabilized surface for placement on a table or high chair tray. The housing forms an outer perimeter, and a vertical housing support connects the housing to the base. A plurality of utensil supports each connect a utensil to the outer perim eter in a cantilevered fashion. The lower support surface may include an attachment mechanism such as a suction cup or a weighted ballast. A rotatable hinge allows the housing to rotate radially relative to the base in a manner adapted to allow access to each of said utensil supports. Each utensil support includes a retention hook to be affixed about the perimeter of the housing and terminating at a distal end at an eyelet. A eating utensil is affixed to said eyelet, and a linearly elongated tether connects the retention to the housing. The tether has a lengths sufficiently long such as to accommodate a parent or child being able to grasp and move the utensil from the organizer to between a feeding position and a table setting. The tether length is also sufficiently short such as to prevent the utensil from hitting a floor if dropped from a table top or high chair.

It is an advantage of the present invention to provide a mechanism for organizing a plurality of utensils in a manner that are both accessible and contained.

It is a further advantage of the present invention to contain the utensils in a manner that prevents dropped utensils from hitting the floor.

Further objects, features, elements and advantages of the present invention will become readily apparent from the following detailed description of the preferred embodiment when considered with the attached drawings and the appended claims.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
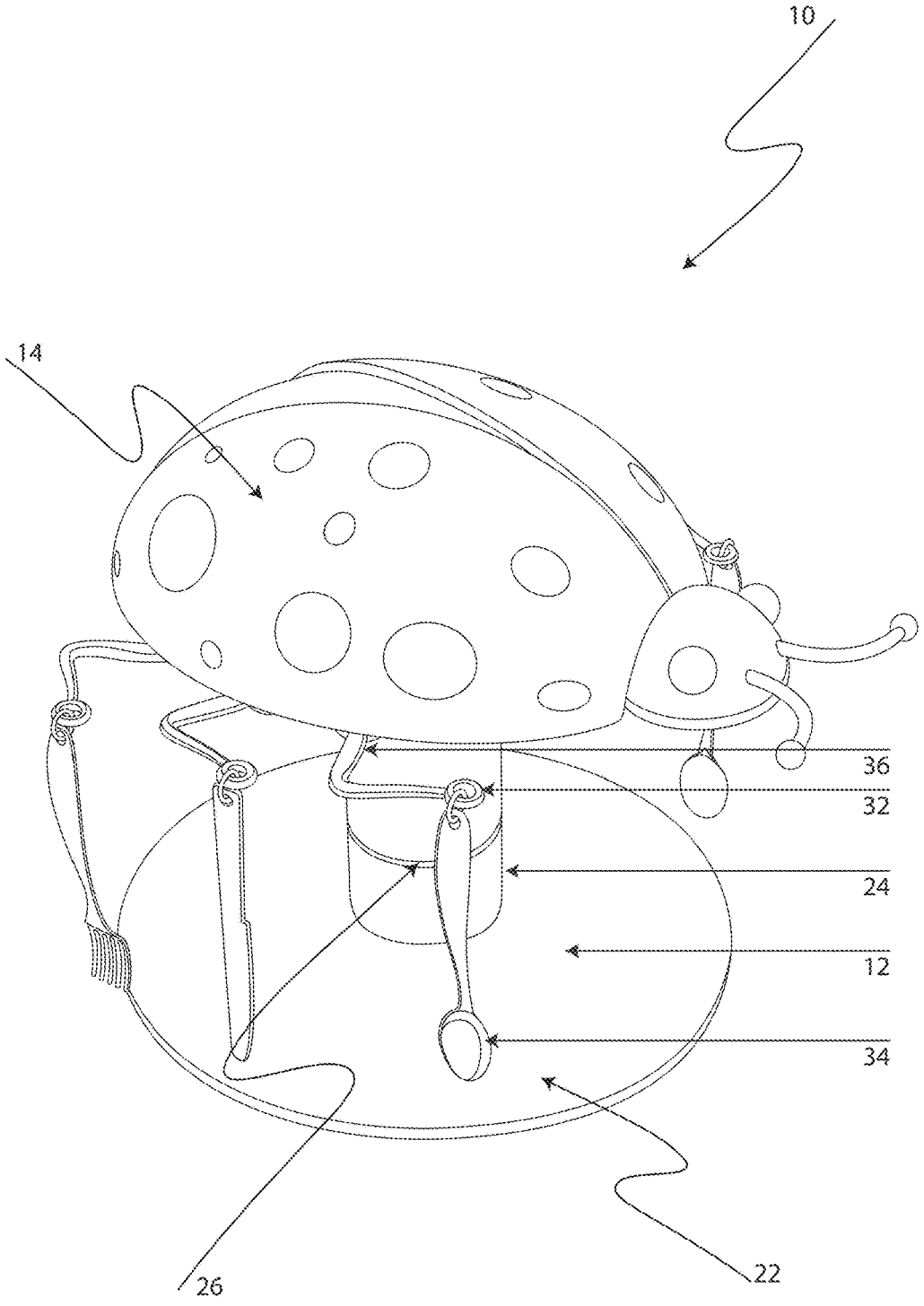
FIG. 1 is a front right perspective view of a utensil retention organizer according to the preferred embodiment of the present invention.
Figure 2:
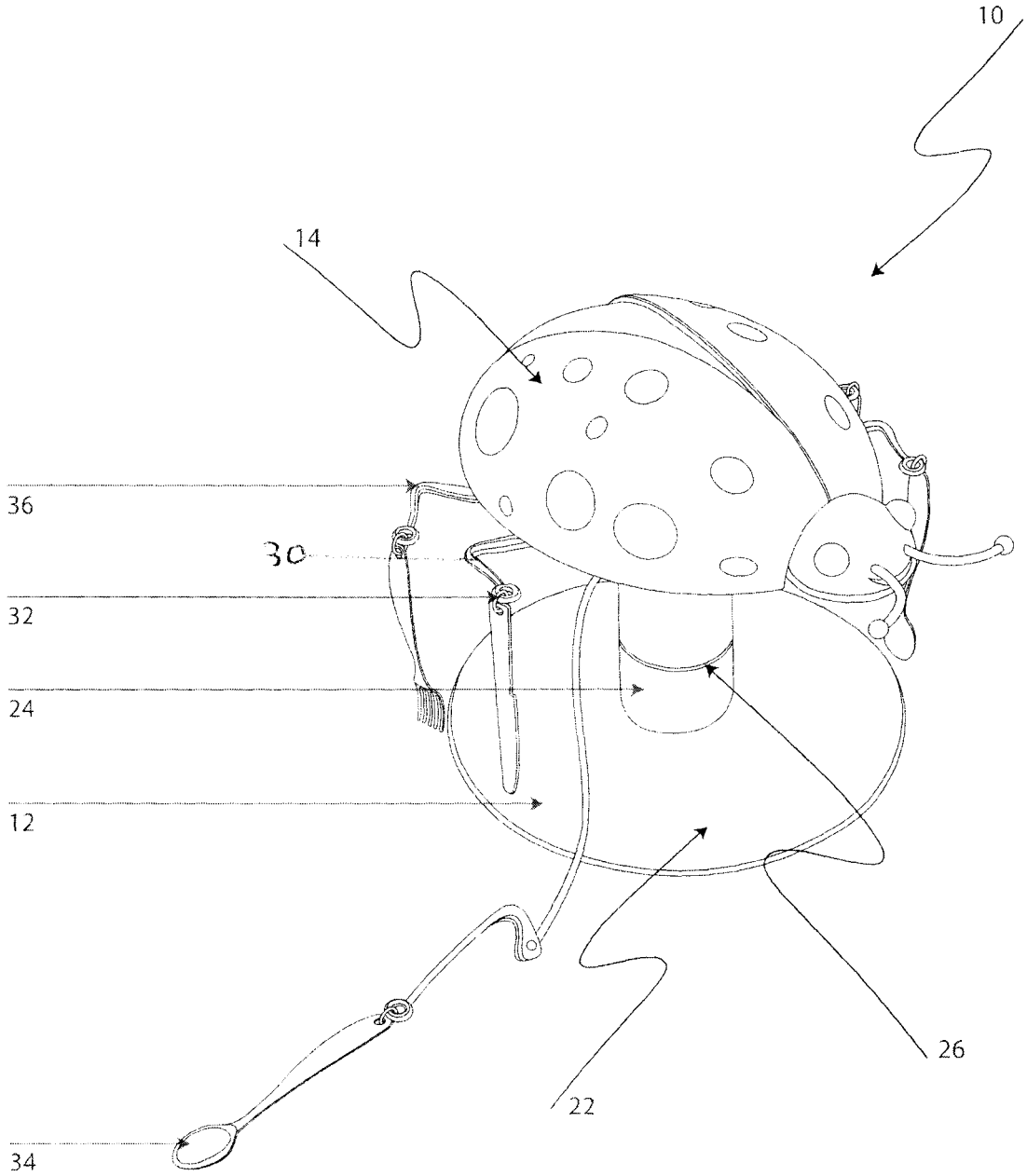
FIG. 2 is front perspective view thereof shown in an exemplary condition having a utensil extended from a tether.
Figure 3:
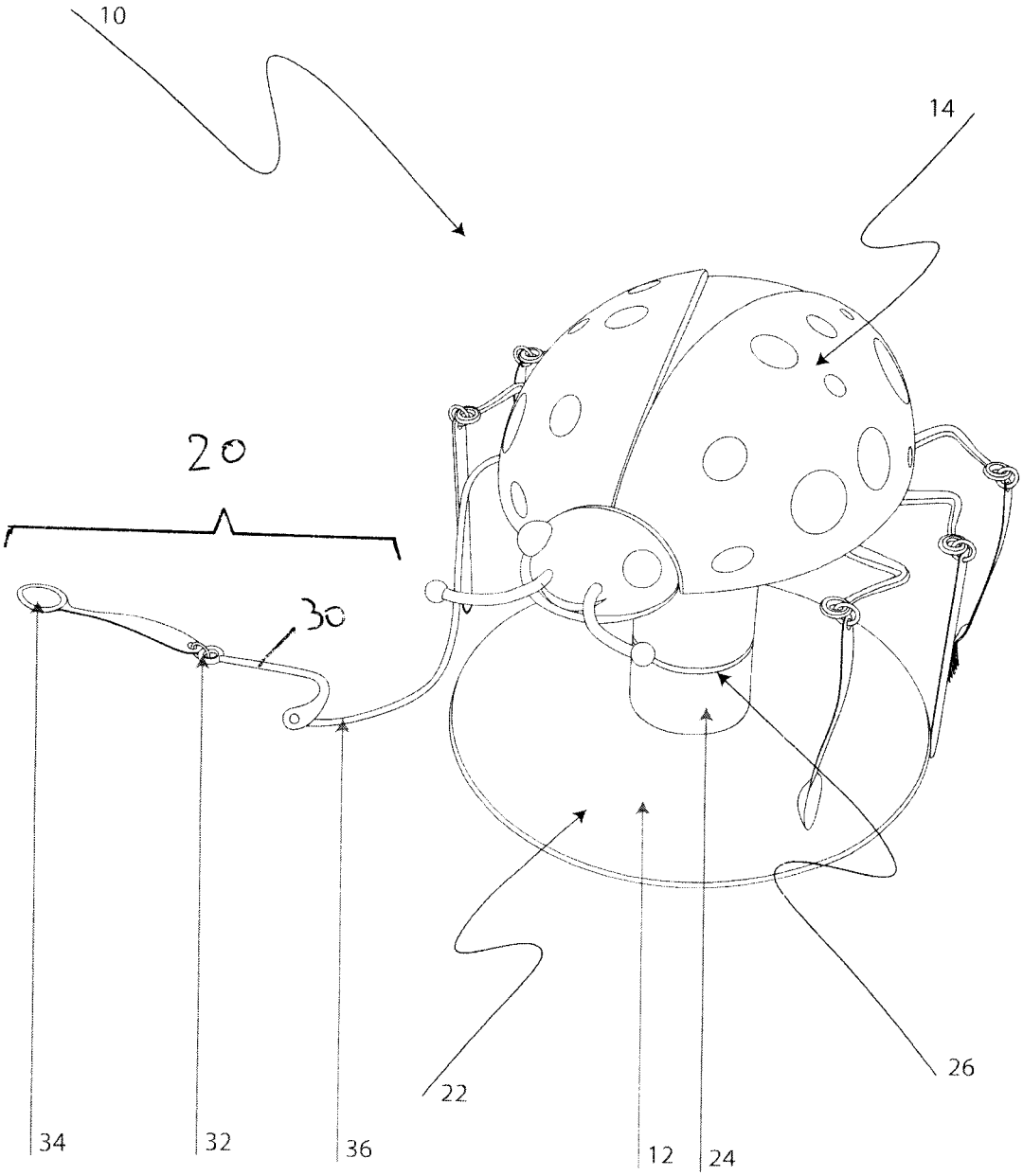
FIG. 3 is a front left perspective view thereof.
Figure 4:
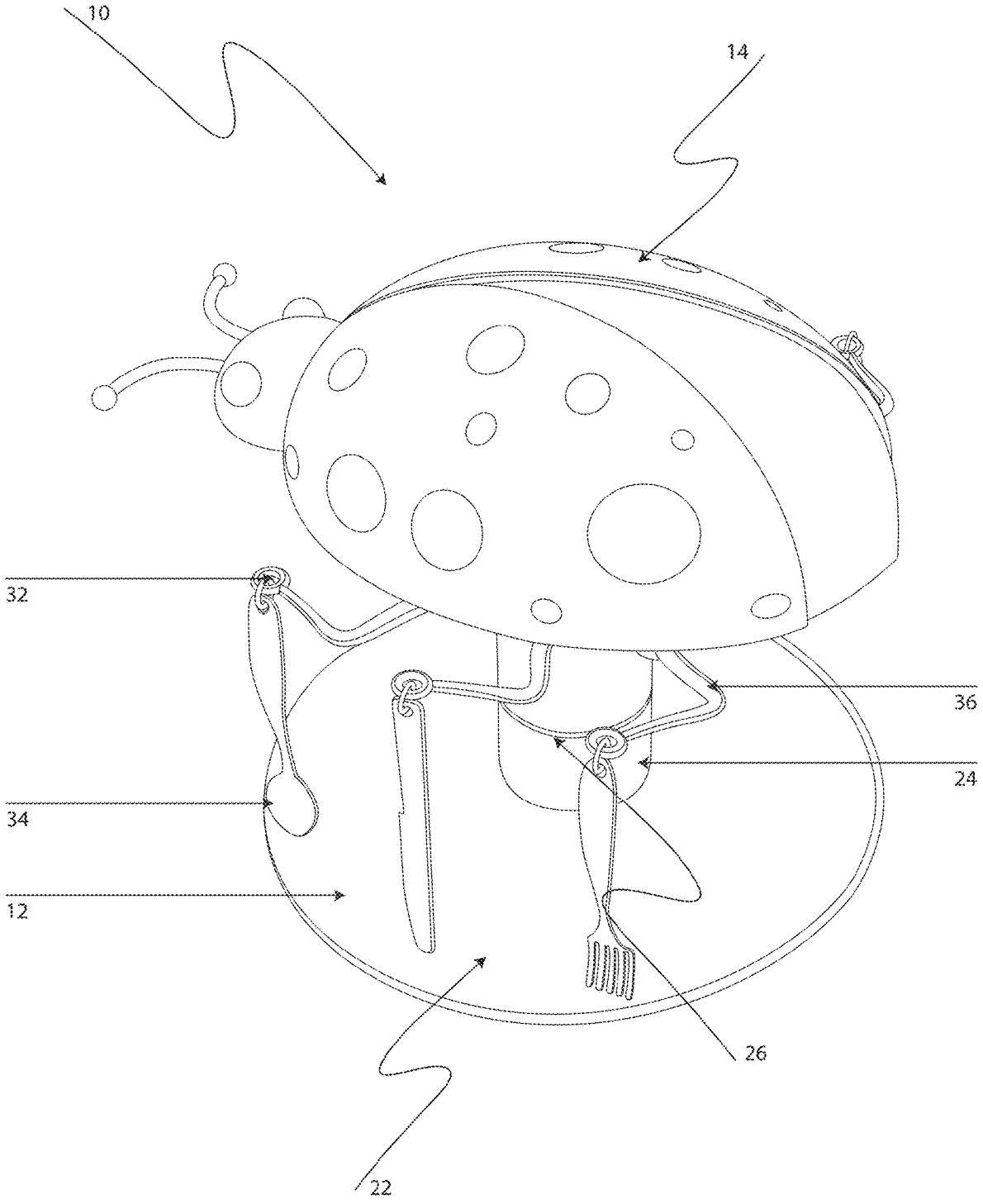
FIG. 4 is a is a rear perspective view thereof.
Figure 5:
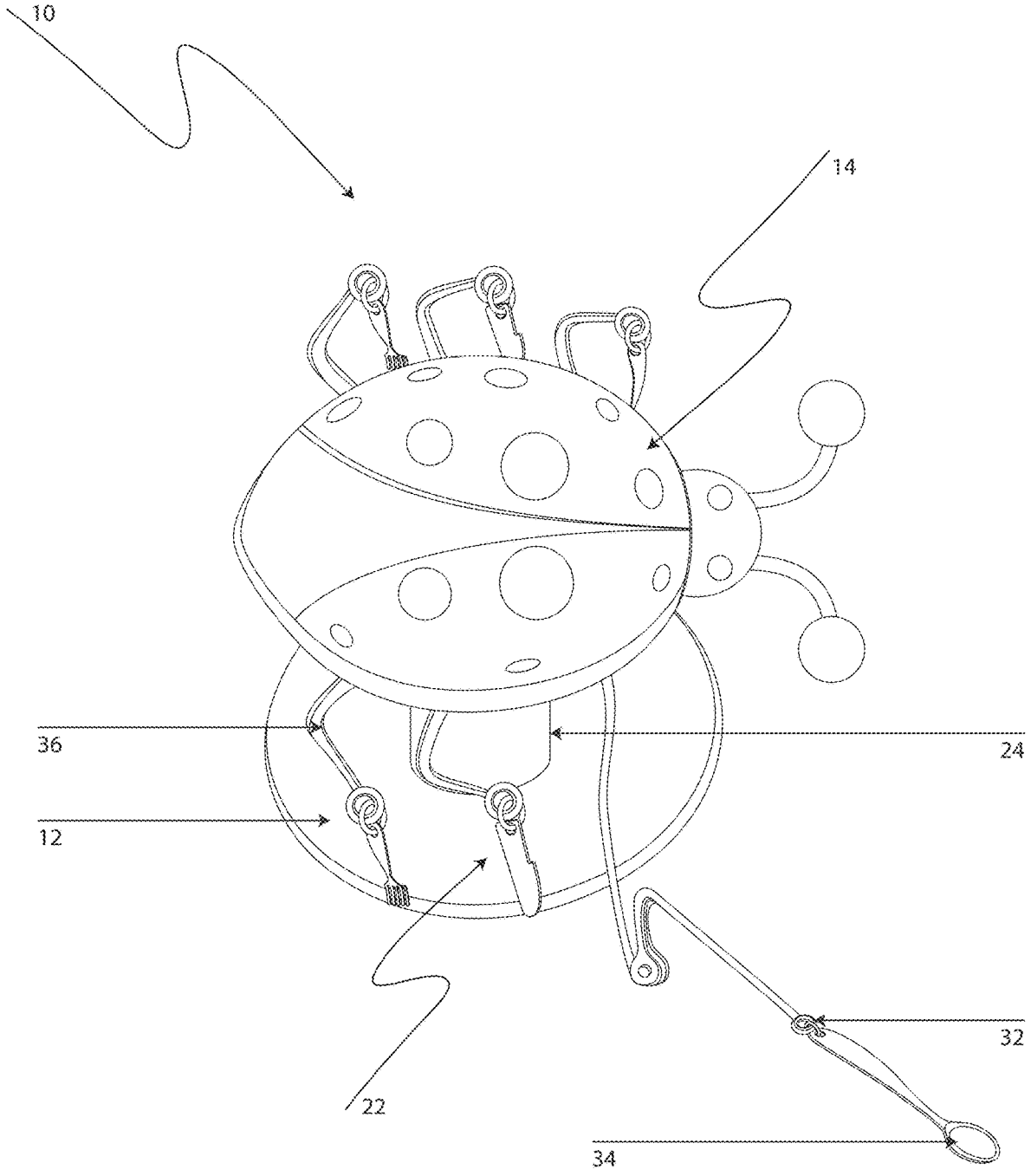
FIG. 5 is a top plan view thereof.
Figure 6:
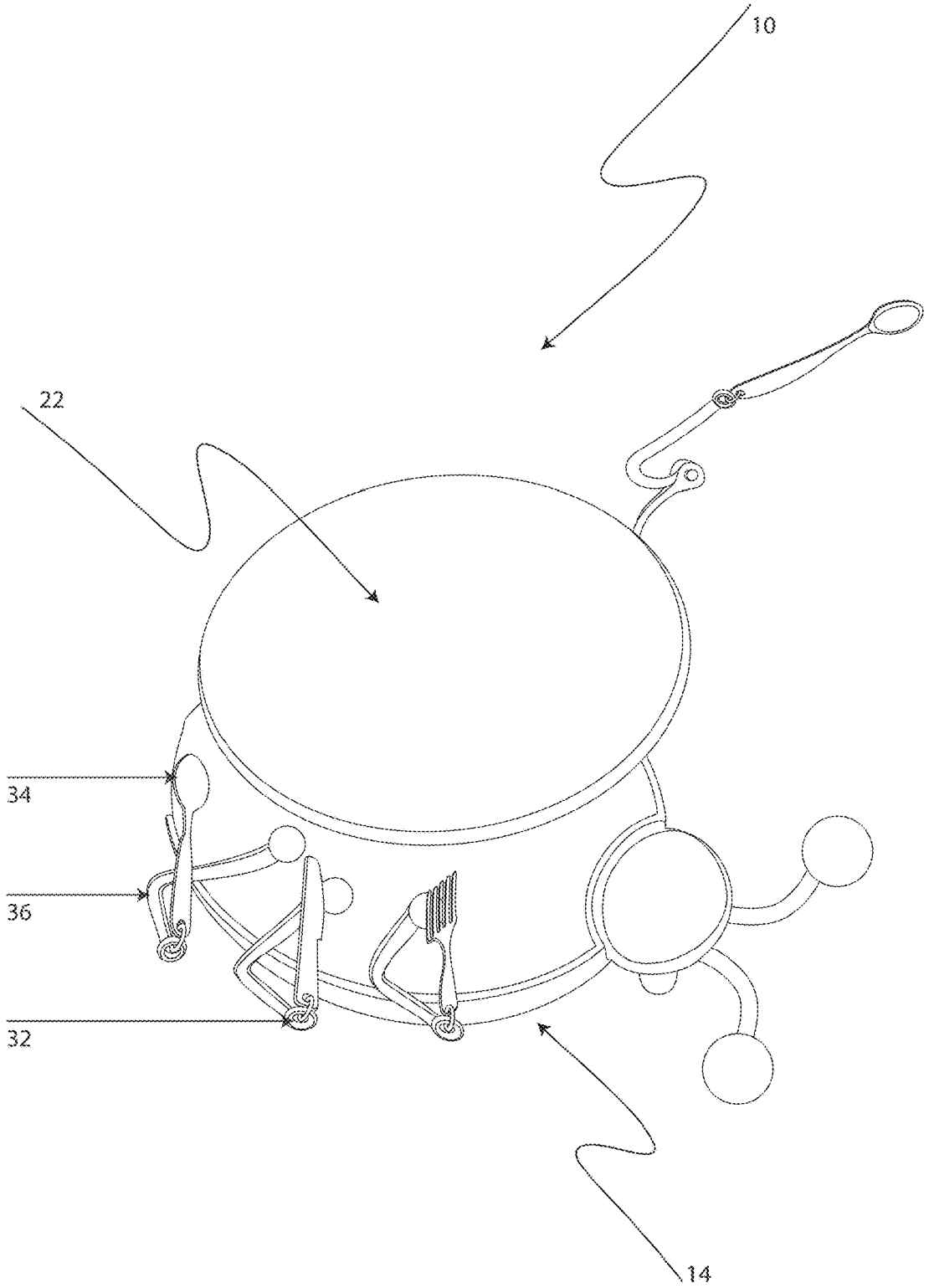
FIG. 6 is a bottom plan view thereof.

The best mode for carrying out the invention is presented in terms of its preferred embodiment, herein depicted within the Figures. It should be understood that the legal scope of the description is defined by the words of the claims set forth at the end of this patent and that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims.

It should also be understood that, unless a term is expressly defined in this patent there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning Finally, unless a claim element is defined by reciting the word "means" and a function without the recital of any structure, it is not intended that the scope of any claim element be interpreted based on the application of 35 U.S.C. § 112, sixth paragraph.

The best mode for carrying out the invention is presented in terms of its preferred embodiment, herein depicted within the Figures.

1. Detailed Description of the Figures

Referring now to the drawings, wherein like reference numerals indicate the same parts throughout the several views, a utensil retention organizer, generally noted as 10, is shown according to the preferred embodiment of the present invention. The organizer 10 includes a base 12, a housing 14, and a plurality of utensil supports 20.

The base 12 provides a flat lower surface 22 that provides a stabilized surface for placement on a table or high chair tray. The lower surface 22 may further include an attachment mechanisms, such as a suction cup or a weight or similar or equivalent mechanism. Further, an upper surface of the base 12 supports a housing support 24 that connects the base 12 to the housing 14. The housing support 24 may further provide a rotatable hinge 26 to allow for the housing 14 to rotate radially in order to better access any of a number of utensil supports 20.

The housing 14 forms an outer perimeter that supports a plurality of utensil supports 20 in a cantilevered fashion. The housing 14 may further provide a decorative form factor, shown herein as having a form giving the general impression of a bug or insect in which each of the utensil supports 20 are positioned to give the impression of the legs of the insect. It is envisioned that similar aesthetic themes, such as an octopus where the utensil supports 20 give the impression of multiple legs, may similarly be used. It is further envisioned that one having ordinary skill in the relevant art, in light of the present teachings, may further provide other themes within the overall scope of the present teachings.

Each of the utensil supports 20 provides a retention hook 30 that can be affixed about a perimeter of the housing 14. Each hook 30 may terminate at an eyelet 32 onto which a different utensil 34 may be affixed. It is also envisioned that in addition to utensils 34, children's toys or amusement object may be further affixed. The distal end of each hook 30 is tethered to the housing 14 itself, with a proximal tether end affixed to the housing 14 and a distal tether end affixed to the hook 30. Although any particular length of tether 36 may be used, it is envisioned that a length of tether 36 may be sufficiently long such as to accommodate a parent or child being able to grasp and move the utensil 34 from the organizer 10 to between a feeding position and a table setting. Similarly, it is also envisioned that a length of tether 36 may be sufficiently short such as to prevent the utensil 34 from hitting the floor if dropped from a table top or high chair.

For purposes of providing enablement of the present innovation, the preferred embodiment is shown in which eating utensils are being tethered to a support. However, it is envisioned that the present invention, when implemented broadly within its range of envisioned equivalents, may be equivalently used for tethering other types of object. By way of example, and not meant as a limitation, the replacement of one or more of the eating utensils may be substituted with other objects (i.e., toys) based upon the intended need. As a result, the term "utensil" is not meant to be limited and merely exemplary.

2. Operation of the Preferred Embodiment

In operation, the organizer 10 of the present invention is adapted for and design to prevent eating utensils or other objects from being dropped and hitting the floor. It is a specially designed toy that prevents toys and silverware from falling off of a table or high chair onto a germ-covered floor, thereby saving the parents time and energy by not having to retrieve the toys or utensils and keep them clean. The base 14 can be adhered to the table or high chair but a suction cup, and the housing 14 may swivel at the base 12 in order to allow it to be easily turned or rotated.

As shown throughout the Figures, the organizer 10 may be in the form of a swivel bug measuring 12 inches high, 12 inches long, and 12 inches wide. With the appearance of a bug or octopus, a number of different eating utensils 34, or a combination of eating utensils 34 and toys or amusement object, may be provided for making the feeding and training of a toddler to feed himself an easier task.

The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein, but is to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way. Any unintended embracement of such subject matter is hereby disclaimed.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

Having thus described the invention what is claimed as new and desired to be secured by Letters Patent is as follows:

1. An eating utensil organizer comprising:

a base providing a lower support surface adapted to provide a stabilized surface for placement on a table or high chair tray;

a housing forming an outer perimeter;

a vertical housing support for connecting the housing to the base; and a plurality of utensil supports each connecting to a utensil to said outer perimeter in a cantilevered fashion via a tether;

wherein each said tether has a length sufficiently long such as to accommodate a parent or child being able to grasp and move the utensil from the organizer to between a feeding position and a table setting and said length is sufficiently short such as to prevent the utensil from hitting a floor if dropped from a table top or high chair.

2. The eating utensil organizer of claim 1, wherein said lower support surface further comprises an attachment mechanism selected from a group consisting of: suction cup; and weights or ballast.

3. The eating utensil organizer of claim 1, wherein said housing support further comprises a rotatable connection adapted to allows the housing to rotate radially relative to a vertical centerline of the base in a manner adapted to allow access to each of said utensil supports.

4. The eating utensil organizer of claim 1, wherein the housing further comprises a decorative form factor.

5. The eating utensil organizer of claim 1, wherein each said utensil support comprises:

a retention hook adapted to be retractably affixed about the perimeter of the housing and terminating at a distal end at an eyelet;

an eating utensil affixed to said eyelet; and a linearly elongated tether having a first end for affixing to a proximal end of said retention hook and a second end for affixing to said housing.

6. The eating utensil organizer of claim 3, wherein the housing further comprises a decorative form factor.

7. The eating utensil organizer of claim 3, wherein each said utensil support comprises:

a retention hook adapted to be affixed about the perimeter of the housing and terminating at a distal end at an eyelet;

an eating utensil affixed to said eyelet; and a linearly elongated tether having a first end for affixing to a proximal end of said retention hook and a second end for affixing to said housing.

8. The eating utensil organizer of claim 7, wherein said housing further provide a decorative form factor a general impression of a bug or insect.

9. The eating utensil organizer of claim 8, wherein each of the utensil supports is positioned to give an impression of the legs of the insect.

10. An object organizer comprising:

a base providing a lower support surface adapted to provide a stabilized surface for placement on an elevated horizontal surface, wherein said lower support surface further comprises an attachment mechanism selected from a group consisting of: suction cup; and weights or ballast;

a housing forming an outer perimeter;

a vertical housing support for connecting the housing to the base;

a plurality of retractable object supports each connecting a graspable object to said outer perimeter in a cantilevered fashion;

wherein each said plurality of object supports comprises: a retention hook adapted to be affixed about the perimeter of the housing and terminating at a distal end at an eyelet;

an eating utensil affixed to said eyelet; and a linearly elongated tether having a first end for affixing to a proximal end of said retention hook and a second end for affixing to said housing, wherein said tether has a length sufficiently long such as to accommodate a user to grasp and move the object from the organizer to between the user and the elevated surface, and wherein said length is sufficiently short such as to prevent the utensil from hitting a floor if dropped from the elevated surface.

11. The object organizer of claim 10, wherein said housing support further comprises a rotatable connection adapted to allows the housing to rotate radially relative to a vertical centerline of the base in a manner adapted to allow access to each of said supports.

* * * * *